US006925838B1

(12) United States Patent
Carmack

(10) Patent No.: US 6,925,838 B1
(45) Date of Patent: Aug. 9, 2005

(54) EARRING SUPPORT DEVICE

(76) Inventor: Jacqueline M. Carmack, 400 Court Pl., P.O. Box 654, Beulah, MI (US) 49617

( * ) Notice: Subject to any disclaimer, the term of this patent is extended or adjusted under 35 U.S.C. 154(b) by 0 days.

(21) Appl. No.: 10/105,776

(22) Filed: Mar. 25, 2002

(51) Int. Cl.[7] ..... A44C 5/00
(52) U.S. Cl. ..... 63/12; 63/13
(58) Field of Search ..... 63/12, 13

(56) References Cited

U.S. PATENT DOCUMENTS

| | | | | | |
|---|---|---|---|---|---|
| 208,230 | A | | 9/1878 | Fuller | |
| 355,007 | A | * | 12/1886 | Dreyfus | 63/13 |
| 360,423 | A | | 4/1887 | Edge | |
| 371,283 | A | | 10/1887 | Smitten | |
| 427,265 | A | * | 5/1890 | Lehmann | 63/13 |
| 477,025 | A | * | 6/1892 | Stern | 63/13 |
| 483,214 | A | * | 9/1892 | Gaynor | 63/13 |
| 502,801 | A | * | 8/1893 | Wodiska | 63/13 |
| 528,197 | A | * | 10/1894 | Woglom | 63/12 |
| 1,106,388 | A | * | 8/1914 | Juergens | 63/14.8 |
| 1,419,021 | A | | 6/1922 | Cicerchi | |
| 1,561,128 | A | * | 11/1925 | Waller | 63/12 |
| 2,629,989 | A | * | 3/1953 | Mcdonald | 63/13 |
| 2,956,422 | A | * | 10/1960 | Davidson | 63/13 |
| 3,071,938 | A | * | 1/1963 | Davidson | 63/13 |
| 3,345,830 | A | * | 10/1967 | Fontaine | 63/13 |
| 3,890,800 | A | * | 6/1975 | Montague | 63/13 |
| 3,975,921 | A | * | 8/1976 | Pomaski | 63/13 |
| 4,221,118 | A | * | 9/1980 | Chicckine | 63/13 |
| 4,249,393 | A | | 2/1981 | Ciambra | |
| 5,044,176 | A | | 9/1991 | King | |
| 5,515,584 | A | | 5/1996 | Adell | |

* cited by examiner

*Primary Examiner*—Robert J. Sandy
*Assistant Examiner*—Katherine Mitchell
(74) *Attorney, Agent, or Firm*—Douglas S. Bishop

(57) ABSTRACT

An earring support device, or finding, which is inserted through a substantially horizontal piercing in the user's earlobe and from which an earring ornament is suspended. A horizontal straight center section of the support is provided to correspond with the piercing of the earlobe and minimize discomfort from the weight of the ornament. The device has two downward portions curvedly attached to, and, suspended, from each end of the horizontal section. One downward portion has a loop at its end to suspend an ornament. The other downward portion is inclined inwardly to hold the support in place.

13 Claims, 1 Drawing Sheet

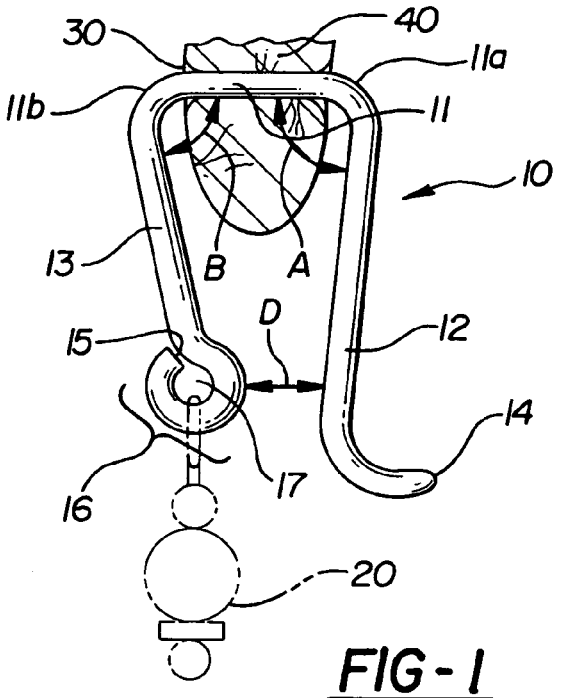
FIG-1
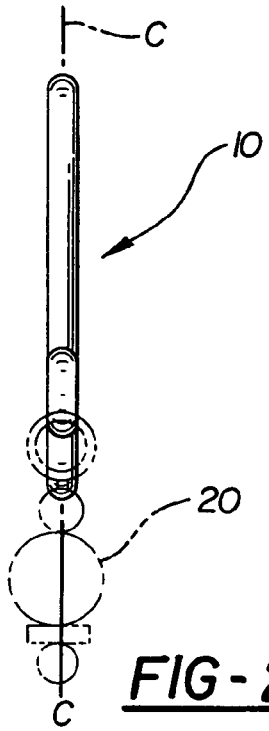
FIG-2
FIG-3
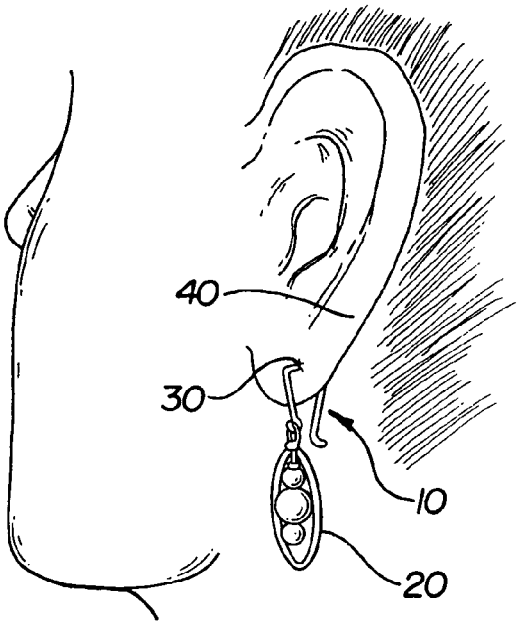
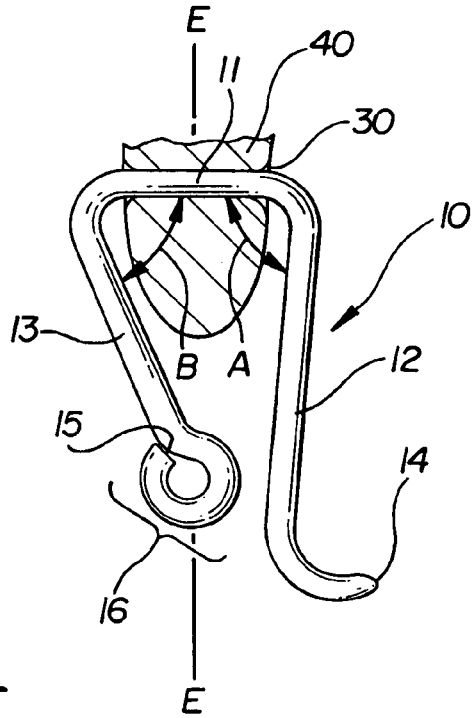
FIG-4

EARRING SUPPORT DEVICE

BACKGROUND OF INVENTION

The concept of utilizing a hook, or "finding", to insert through a piercing in a wearer's ear is obviously known. U.S. Pat. No. 1,419,021, to Cicerchi discloses an earring assembly, a portion of which is inserted through a piercing in the wearer's lobe. Similarly, U.S. Pat. No. 5,044,176, to King, is directed to a support cradle for a pierced earring, to reduce stress to the user's earlobe. U.S. Pat. No. 371,283, to Smitten, discloses an earring assembly for a pierced ear with a locking mechanism to hold the earring in place. U.S. Pat. No. 360,423, to Edge, discloses a pierced earring with a spring bow and catch. Another example of prior art is U.S. Pat. No. 4,249,393, to Ciambra, for an earring which loops the bottom portion of the wearer's lobe and penetrates a piercing. U.S. Pat. No. 208,230, to Fuller, demonstrates that use of a finding to hold an earring in place was known in 1878.

Including those mentioned in the referenced prior art, these are a number of ways to attach an ornament or earring to a wearer's earlobe. These include the kidney wire, the shepherd hook, with the penetrating portion thereof curved in a hooking fashion, the hinge lever post, as well as a ball post with ring, which latter application requires a friction nut. Such findings are all available and mass produced for utilization in jewelry manufacture.

There is not, however, full satisfaction with any of the existing prior art. Wearers complain of the loss of earring ornaments, discomfort, difficulty in affixing, or a combination thereof, with regard to existing earring findings.

A number of existing applications require two parts to make them secure, which presents difficulties in assembly and in fixation on the ear, because of the relatively small size of the individual parts. Prior art using hinged mechanisms is also costly to produce.

Standard "shepherd hook" findings, which are essentially findings with a large, curved hook which fits through the lobe piercing, without a separate fastener, are relatively easy to use and easy to attach an ornament to, but are also easily disengaged and often lost, along with the suspended ornament.

Existing "shepherd hook" findings also provide a curved supporting portion, which rests within a substantially straight, and approximately horizontal, aperture or piercing in the wearer's earlobe. The curved hook slides out of the straight piercing more easily. Also, as the weight of the suspended ornament places pressure on the earlobe, a curved finding within a straight piercing understandably places more pressure on each end of the piercing, rather than equally distributing it across the length of the piercing.

Accordingly, a need exists for an earring finding or support, of one piece unitary construction, to which an ornament may easily be attached, which will insert easily into a pierced earlobe, which will not be easily dislodged, and which will minimize discomfort to the wearer.

FIELD OF INVENTION

This invention relates to jewelry attachments and devices generally, and, more specifically, to support or suspending devices to hold ornamental jewelry in place on a wearer. While the present invention may have application to other body piercings, it is particularly adopted to earrings and ornaments suspended from pierced earlobes.

SUMMARY OF THE INVENTION

The present invention is directed to an earring support device or finding which is of one piece construction, is easily insertable through an earlobe piercing, is held easily in place, and which minimizes discomfort to the wearer.

The present invention departs from the prior art in its unitary construction, by using straight resiliently rigid lines and curves only when making transitions between sections. Curved (curvilinear) corners allow for ease when traveling through a piercing, yet the straight portions, when in place, maximize retention within the piercing.

The present invention is formed from one piece of resiliently pliable wire material. It is bent to provide a straight central portion, which ultimately rests in a straight piercing within the earlobe. At each end of the central portion, the wire is curvilinearly bent, so that two generally straight end members are provided. These extend outward, together, from the respective ends, with bends where they are attached so as to provide a generally curved and smooth transition from the central portion to the two end portions. The central portion and both end portions are in the same general plane, so that the device would lie substantially flat if laid upon a singularly planar surface. The end portions extend outwardly and generally toward each other. One end portion is formed into a loop at its outer end to provide a means for hanging an ornament. The other end portion is curved at its outer end, generally out and away from the other end portion. It is this end portion which is inserted through the ear piercing, with the curved portions of the device, in conjunction with the pliable nature of the earlobe, facilitating smooth passage. The central straight portion with curvilinear transition to the corresponding end portions, rests uniformly within the piercing through the width of the earlobe.

BRIEF DESCRIPTION OF THE DRAWINGS

The following detailed description is best understood with reference to the accompanying drawings, in which:

FIG. 1 is a front perspective view of the invention, showing the device as used in place with a cross-sectional view of a pierced earlobe, and showing, in outline, the normal position of an ornament when suspended therefrom;

FIG. 2 is a side view of the device, showing the alignment of all portions thereof in a common plane, and showing, in outline, the normal position of an ornament when suspended therefrom.

FIG. 3 is a perspective view of the device, as inserted through a piercing in the earlobe of a user, with an ornament suspended therefrom.

FIG. 4 is a front perspective view of the invention showing the device as used in place with a cross-sectional view of a pierced earlobe, showing the embodiment of the invention wherein the means of affixing an ornament is centered below the pierced section of a user's earlobe.

DETAILED DESCRIPTION OF THE PREFERRED EMBODIMENT

The invention, earring support device, broadly considered, comprises a formed, rigidly resilient, single filament member 10, which, in the preferred embodiment, the rigidly resilient, single filament is a fine gauge wire. Rigidly resilient is defined as being substantially non-bendable, thus, if moved to a degree, is not rigidly breakable and will return to its position. Member 10 further has a straight center portion or section 11, with a first end 11*a* and a second end 11*b*. A first end section 12 extends in a curvilinear relationship from section 11 at first end 11*a* at angle A. Angle A is no greater than 90° and in the preferred embodiment angle A is less than 90°.

A second end section 13 extends in curvilinear relationship at angle B from section 11 at second end 11*b*. Angle B is no greater than 90° and in the preferred embodiment angle B is less than 90°.

First end section 12 terminates at first outer end 14. Second end section 13 terminates at second outer end 15. End sections 12 and 13, respectively, are substantially straight for the majority of their respective lengths between first end 11*a* and first end outer end 14 and between second outer end 15, respectively.

First end section 12 and second end section 13 extend correspondingly and opposingly outwardly from section 11, in a substantially common plane C—C, as shown in FIG. 2. First end section 12 is at least as long as section end section 13, and, in the preferred embodiment of the invention, first end section 12 is longer than second end section 13. Second end section 15 is a distance D from first end section 12, and in the preferred embodiment, distance D is less than the length of section 11 between first end 11*a* and second end 11*b*.

As a means of attaching an ornament 20, second end section 13, at second end 15, forms a loop 16, with loop 16 further defining an aperture 17.

In the preferred embodiment, first end section 12 is further curved outwardly from section end section 13, at first outer end 14, in plane C—C.

In a further preferred embodiment of the invention, the second outer end 15 is positioned so that a line E—E bisecting section 11 in plane C—C also bisects loop 16.

The member 10 is configured to support an ornament 20, through a substantially horizontal body piercing 30 in a user's ear 40. The resilient rigidity of member 10, allows the expansion of distance D between end sections 12 and 13, when inserting the invention into aperture 30 of a user's ear.

In the preferred embodiment, where both angle A and angle B are less than 90°, first end section 12 and second end section 13 are downwardly disposed when section 11 is inserted through aperture 30 of the user's ear 40, and are inwardly inclined from the vertical toward each other, as shown in FIGS. 1 and 3.

WHEREAS, a preferred embodiment of the invention has been illustrated and described in detail, it will be apparent that various changes may be made in the disclosed embodiment without departing from the spirit of the invention.

What is claimed is:

1. An earring support device comprising:

a formed, rigidly resilient, single filament member, wherein said single filament member further comprises:

a straight linear center section of defined length, having a first end and a second end;

a first end section extending from the first end of said center section and terminating at a first outer end;

a second end section extending from the second end of said center section and terminating at a second outer end;

said second outer end conformed to form a loop defining an aperture at said second outer end;

said first end section being at least as long as said second end section;

said first end section and said second end section extending correspondingly downwardly from said center section in a substantially common plane;

said second outer end being established at a defined distance from said first end section to facilitate attachment of said device through a user's earlobe;

said separation distance further being less than the length of said center section; and said first end section and said second end section being separated at all times by a distance no less than the distance between said second outer end and said first end section.

2. The earring support device of claim 1, wherein, the loop defining an aperture at the second outer end comprises a means for attaching an ornament.

3. The earring support device of claim 2, wherein the loop formed by the second outer end is positioned so that an axis bisecting the center section at right angles bisects the loop formed at said second outer end and so as to facilitate load equalization of a suspended ornament.

4. The earring support device of claim 1, wherein, the single filament member is comprised of fine gauge wire.

5. The earring support device of claim 1, wherein, said first end section is of greater length then said second end section.

6. The earring support device of claim 1, wherein, said first end section is further curved outwardly proximate to said first outer end.

7. The earring support device of claim 1, wherein each of the first end section and the second end section extend from the first end and second end, respectively, at an interior angle of less than ninety degrees.

8. The earring support device of claim 1, wherein each of the first end section and the second end section extend by curvilinear bend from the first end and second end respectively.

9. An earring support device configured to vertically support an ornament through a horizontal body piercing aperture, comprising:

a one piece rigidly resilient wire, further comprising:

a horizontally inclined straight central portion of defined length, having a first end and a second end;

a first downwardly disposed portion of defined length and terminating at a first outer end extending by curvilinear bend from the first end of the horizontally inclined portion;

a second downwardly disposed portion of defined length and terminating at a second outer end extending by curvilinear bend from the second end of the horizontally inclined portion;

said first downwardly disposed portion and second downwardly disposed portion extending in separation from each other downwardly from said horizontally inclined portion in a common plane;

said second outer end comprised of a loop forming an aperture being established at a defined distance from said first downwardly extended portion.

10. The earring support device of claim 9, wherein said first downwardly disposed portion and said second downwardly disposed portion are inwardly inclined toward each other in their downwardly disposed extension.

11. The earring support device of claim 9, wherein the first downwardly disposed portion, at the end of its defined length extending downwardly from said first end, is curved outwardly and away from said second downwardly disposed portion.

12. An earring support device configured to vertically support an ornament through a body piercing aperture, comprising:

a one piece rigidly resilient wire, further comprising:

a horizontal inclined straight central portion of defined length, having a first end and a second end;

a first downwardly disposed portion of defined length terminating at a first outer end and extending by curvilinear bend from the first end of the horizontal portion;

a second downwardly disposed portion of defined length terminating at a second outer end and extending by curvilinear bend from the second end of the horizontal portion;

said first downwardly disposed portion and second downwardly disposed portion extending in separation from each other downwardly from said horizontal portion in a common plane;

said second outer end of second downwardly disposed portion comprising a loop forming an aperture as a means to suspend an ornament at the second outer end;

said first downwardly disposed portion and second downwardly disposed portions being inwardly inclined toward each other in their downwardly disposed extension;

the loop configuration of said second outer end being established at a defined distance from said first downwardly disposed portion and to facilitate attachment of said device through a user's earlobe; and said loop means to affix an ornament positioned so that an axis bisecting the straight central portion at right angles bisects said loop means and to facilitate load equalization of a suspended ornament.

13. The earring support device of claim 12, wherein the defined distance between the loop configuration of the second outer end and the first downwardly disposed portion is less than the defined distance of the straight central portion.

* * * * *